US012287138B2

(12) United States Patent
Tracy et al.

(10) Patent No.: US 12,287,138 B2
(45) Date of Patent: Apr. 29, 2025

(54) MOBILE LOCKER WITH TEMPERATURE CONTROL AND MONITORING

(71) Applicant: GM GLOBAL TECHNOLOGY OPERATIONS LLC, Detroit, MI (US)

(72) Inventors: Adam Tracy, San Jose, CA (US); Ryan Braunstein, San Carlos, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 224 days.

(21) Appl. No.: 17/946,568

(22) Filed: Sep. 16, 2022

(65) Prior Publication Data

US 2024/0093929 A1 Mar. 21, 2024

(51) Int. Cl.
*F25D 11/02* (2006.01)

(52) U.S. Cl.
CPC ..... *F25D 11/02* (2013.01)

(58) Field of Classification Search
CPC ..... F25D 11/02; F25D 13/04; F25D 13/02; F25D 11/006; F25D 2303/08; F25D 3/06; F25D 2400/20; F25D 2700/12; B60H 1/005
See application file for complete search history.

(56) References Cited

U.S. PATENT DOCUMENTS

| | | | | |
|---|---|---|---|---|
| 10,955,188 | B2 * | 3/2021 | Chan | F25D 11/003 |
| 11,396,415 | B2 * | 7/2022 | Kilmer | F28D 20/026 |
| 2017/0292759 | A1 * | 10/2017 | Al-Hallaj | B60H 1/00014 |
| 2018/0041493 | A1 * | 2/2018 | Wilkinson | H04L 63/08 |
| 2021/0309442 | A1 * | 10/2021 | Kletzel | F25D 3/107 |

* cited by examiner

*Primary Examiner* — Lionel Nouketcha
(74) *Attorney, Agent, or Firm* — Quinn IP Law

(57) ABSTRACT

A mobile locker includes one or more dispensing units. Each dispensing unit consists of an accessible product space where each product space also includes a temperature monitor. A passible environmental control incudes a multiple of containers located around the perimeter of each accessible product space. Further, each of the containers incorporates a phase change material (PCM) that is used to temperature condition each accessible product space.

16 Claims, 5 Drawing Sheets

MOBILE LOCKER WITH TEMPERATURE CONTROL AND MONITORING

Mobile home delivery, curbside pickup, contactless purchasing, all of these aspects of purchasing products and delivery systems have become an ever increasing aspect of life. However, such systems also have limitations. For example, the delivery of perishable products, such as some grocery items, cannot tolerate extreme temperatures. Fresh lettuce may wilt under high temperatures or freeze in low temperatures. Insulation within a delivery system may be used to somewhat isolate products from the environment, but only for a limited amount of time. The use of dry ice or freezable ice packs may provide cooling, but start to degrade immediately, and do not protect contents from cold weather. Chemical heat packs may be used in cold weather but suffer from the same limitations as cooling packs. In addition, such ice or heat packs take up valuable space in a delivery system.

Active refrigeration and heating units have been used in stationary and mobile delivery systems, but require power, something that may not be available in all situations. Peltier thermoelectric coolers (TEC) utilize power to transfer heat between two electrical junctions. Known as the "Peltier" effect, discovered by Jean Peliter in 1834, when a direct current flows through the junctions of the two conductors heat is removed at one junction thus creating a cooling effect. However, Peltier devices are inefficient. The flowing current itself tends to generate a significant amount of heat, which requires additional heat dissipation measures.

Compressors and heat pump systems may also be used in delivery systems, but require large amounts of space and power, in addition to maintenance concerns and its associated costs.

SUMMARY

Disclosed herein is a mobile locker style storage system having multiple dispensing units. The dispensing units may be self contained mobile enclosures that each include multiple accessible product spaces configured to hold product, including perishable food products and other items requiring an environmentally temperature controlled space. A passive environmental control system is used to control temperatures within each of the accessible product spaces. The passive environmental control system utilizes phase change material (PCM) embedded within the walls, floor, ceiling, and door of each accessible product space. PCM is available in a wide range of "melting points." The melting point of a PCM product is the temperature where the PCM starts to absorb energy. For example, a PCM with a melting point of 70 degrees Fahrenheit will start to absorb energy at 70 degrees thereby creating a cooling effect. The PCM will continue to absorb energy, and thus continue to cool the product space, as the outside temperature rises. At some point, the PCM will become depleted, or exhausted, and will no longer be able to absorb energy, e.g., an inability to maintain environmental control, at which point will need to be reconditioned. Such reconditioning may be accomplished by moving the PCM to a room temperature environment that is at or below the melting point of the PCM.

In a similar manner, a PCM with a configured melting point at a lower temperature, for example at 40 degrees Fahrenheit. PCM at this melting point temperature may be used to release energy. Thus, if the mobile locker system is deployed to a cold climate where cooling of product is not an issue, by keeping that product from freezing, would utilize such a PCM. Further, a combination of different types of PCM matter with different melting points may be configured or reconfigured to provide both cooling, e.g., a cooling mode, in a warm environment and heating, e.g., a heating mode, in a cold environment. Or, different types of PCM matter could be configured or reconfigured to provide multiple melting points in only a warm environment, for example a first melting point of 70 degrees and a second melting point at 80 degrees Fahrenheit. The same configuration could also be applied to releasing heat in a cold environment with multiple sets of melting points. The examples given here are not meant to limit the number or types of multiple PCM matters that may be configured.

The mobile locker, with the use of PCM with a passive environmental control system provides cooling or heating without the use of power. Further, unlike the use of ice packs or chemical heating packs that immediately start to heat or chill a surrounding area, a PCM only starts to absorb or release energy upon reaching its melting or freezing point. Thus, given the 70 degree Fahrenheit PCM melting point example, that PCM matter does not start absorbing energy providing cooling, until the PCM reaches 70 degrees. Accordingly, the passive PCM environmental control system provides an efficient cooling and/or heating system without the use of external power.

Another aspect of the disclosure includes the inclusion of an auxiliary power supply, to provide power for such functions as to propel each mobile locker by an electrified powertrain system mounted in the mobile locker. In some aspects of the disclosure, the auxiliary power could also be used for fans or other devices to assist in reconditioning the PCM. Reconditioning, temperature conditioning, or temperature-controlled, may be accomplished in multiple ways depending upon the type of PCM material. For example, the PCM may be conditioned to cool a product space by absorbing energy or it may be conditioned to heat a product space by discharging energy.

A PCM container absorbs or discharges a finite amount of energy at which point it needs to be reconditioned or recharged, which may be done by placing the PCM container in an environment less than its melting point to discharge absorbed energy or in an environment greater than its freezing point to absorb energy. The placement of a PCM container in an environment for reconditioning is considered to be a passive action as no power is required to operate. Further, for example, the PCM container could be placed in a room environment suitable for conditioning or reconditioning, such as in an air-conditioned room at 68 degrees Fahrenheit or in a walk-in freezer at 3 degrees Fahrenheit.

In an embodiment, the PCM matter may be contained in bottles, flasks, or any shaped container that are modular and may be removed from the mobile locker. As the PCM containers may be modular, they may also contain different types of PCM matter. For example, one set of PCM containers may contain a first type of PCM matter with a first melting point and another set of PCM container may contain a second type of PCM matter with a second melting point. In some embodiments the range of melting points of the PCM matter may range from a low of 40 degrees to a high of 100 degrees Fahrenheit. In another example, the one set of PCM containers may be vertically oriented in the mobile locker while the other set of PCM containers may be horizontally oriented.

Each mobile locker may contain multiple dispensing units with each dispensing unit defining an accessible product space, for example with a hinged door that may be manually or automatically opened or closed. In an embodiment, each of the product spaces may also be equipped with a temperature sensor. The temperature sensor may provide information regarding a current temperature of the accessible product space, but it also is an indicator of the performance of the PCM matter. For example, if the PCM is configured to absorb energy and provide cooling for a particular product space the temperature monitor may provide a current temperature and a history of temperatures over time thereby indicating the performance of the PCM matter. The temperature monitor may also indicate a particular rise in temperature indicating that the PCM matter needs to be reconditioned. The temperature monitor may also be equipped to produce a warning or indicator when the detected temperature is above or below a threshold value.

Aspects of the disclosure also includes a method for the temperature controlled transport of product. Such a method may include automatically opening an access door on a mobile locker, where the mobile locker is configured to be mobile and includes multiple dispensing units, each configured with an access door. The mobile locker, with an opened access door, may be located in a room temperature environment that is suitable for PCM reconditioning. With an open access door, the accessible product space is exposed to the room temperature environment. Therefore, given the example discussed above, if the PCM matter is configured with a melting point of 70 degrees Fahrenheit and the mobile locker is located in an area maintained at 68 degrees Fahrenheit, then the PCM matter will be conditioned as the 68 degree temperature will allow the PCM matter to discharge its stored energy. Thus, when the PCM matter is exposed to a temperature greater than 70 degrees Fahrenheit it will start to absorb energy and provide a cooling effect.

The method may also include automatically closing the access doors. For example, a temperature monitor may indicate the accessible product space has been below a threshold temperature value for a set period of time and determine that the PCM matter would be fully conditioned and accordingly close the access door. In an embodiment, the temperature monitor may be linked via a telecommunication link to automatically open or close the access doors. Such an action may also be triggered by the temperature monitor detecting the temperature within the accessible product being above or below a threshold level.

In another embodiment of the present disclosure, a mobile locker style storage system may include one or more mobile lockers and a delivery vehicle configured to transport the one or more mobile lockers. For example, the mobile locker style storage system may be configured to store and preserve grocery and other perishable items. The delivery vehicle may therefore be used to transport and deliver a mobile locker to a customer location.

The above features and advantages, and other features and attendant advantages of this disclosure, will be readily apparent from the following detailed description of illustrative examples and modes for carrying out the present disclosure when taken in connection with the accompanying drawings and the appended claims. Moreover, this disclosure expressly includes combinations and sub-combinations of the elements and features presented above and below.

BRIEF DESCRIPTION OF THE DRAWINGS

The accompanying drawings, which are incorporated into and constitute a part of this specification, illustrate implementations of the disclosure and together with the description, serve to explain the principles of the disclosure.

Figure 1:
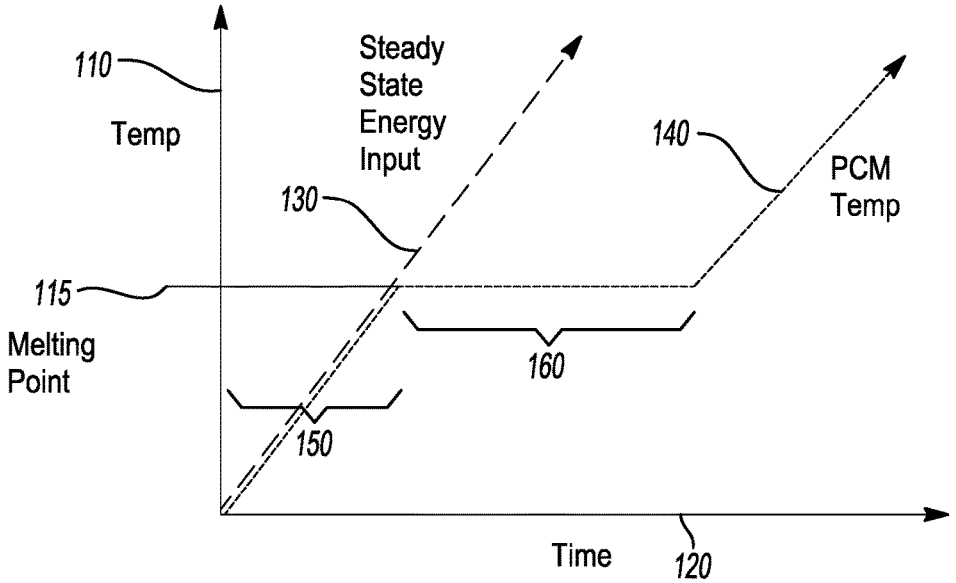
FIG. 1 is an illustration of a PCM matter exposed to a steady state energy input.

The appended drawings are not necessarily to scale and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The present disclosure is susceptible of embodiment in many different forms. Representative examples of the disclosure are shown in the drawings and described herein in detail as non-limiting examples of the disclosed principles. To that end, elements and limitations described in the Abstract, Introduction, Summary, and Detailed Description sections, but not explicitly set forth in the claims, should not be incorporated into the claims, singly or collectively, by implication, inference, or otherwise.

For purposes of the present description, unless specifically disclaimed, use of the singular includes the plural and vice versa, the terms "and" and "or" shall be both conjunctive and disjunctive, and the words "including", "containing", "comprising", "having", and the like shall mean "including without limitation". Moreover, words of approximation such as "about", "almost", "substantially", "generally", "approximately", etc., may be used herein in the sense of "at, near, or nearly at", or "within 0-5% of", or "within acceptable manufacturing tolerances", or logical combinations thereof. As used herein, a component that is "configured to" perform a specified function is capable of performing the specified function without alteration, rather than merely having potential to perform the specified function after further modification. In other words, the described hardware, when expressly configured to perform the specified function, is specifically selected, created, implemented, utilized, programmed, and/or designed for the purpose of performing the specified function.

Figure 3:
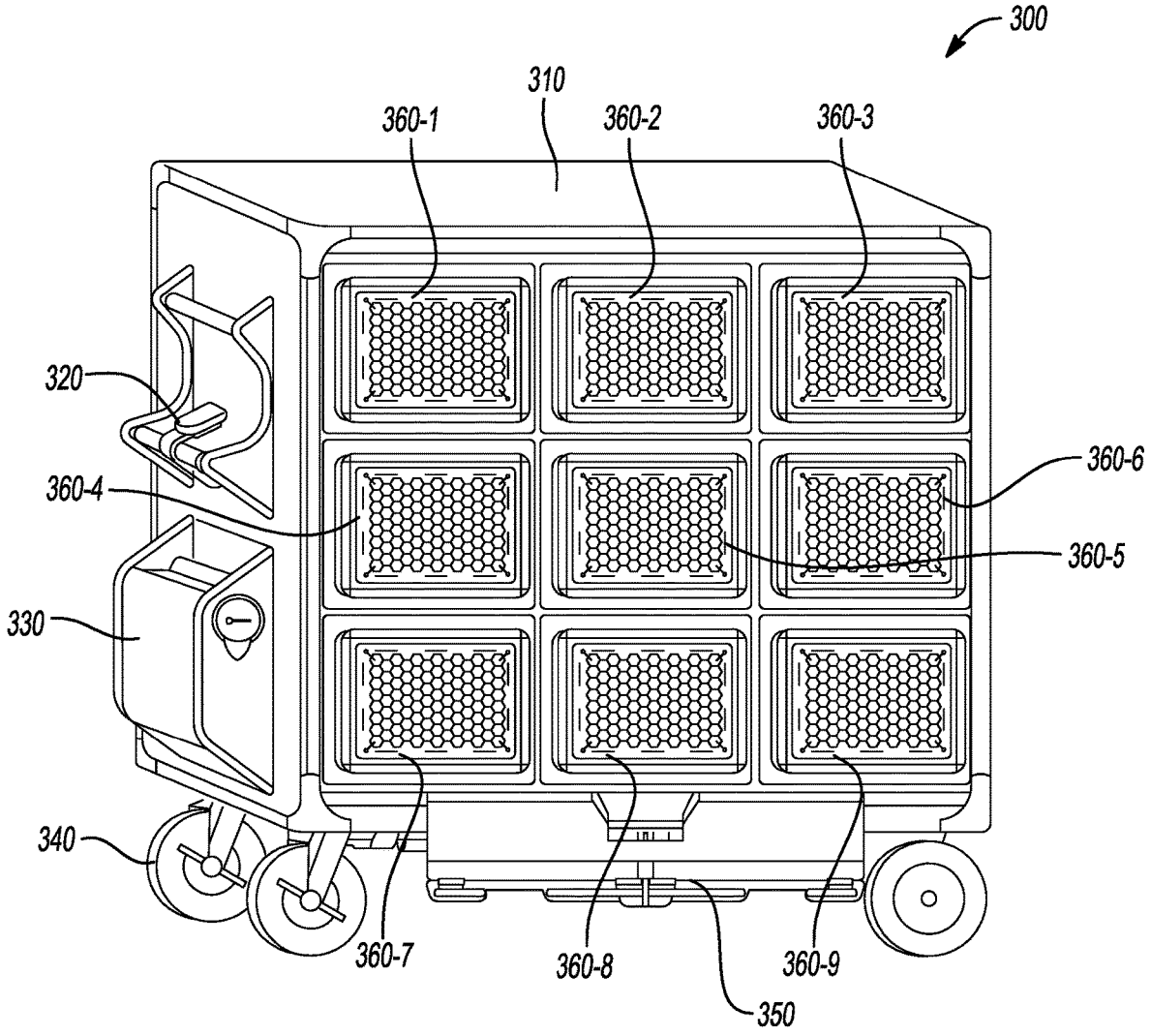
FIG. 3 is an illustration of a mobile locker system in accordance with the disclosure.

Referring to the drawings, the left most digit of a reference number identifies the drawing in which the reference number first appears (e.g., a reference number '310' indicates that the element so numbered is first labeled or first appears in FIG. 3). Additionally, elements which have the same reference number, followed by a different letter of the alphabet or other distinctive marking (e.g., an apostrophe), indicate elements which may be the same in structure, operation, or form but may be identified as being in different locations in space or recurring at different points in time (e.g., reference numbers "110*a*" and "110*b*" may indicate two different input devices which may functionally the same, but may be located at different points in a simulation arena).

In a representative use case, a mobile locker utilizes PCM matter as a passive environmental control to maintain a desired temperature condition within dispensing units in the mobile locker. To understand the concept of utilizing PCM matter, FIG. 1 illustrates the temperature reaction of a PCM matter to a steady state energy input over time. Phase change material is a substance that either discharges or absorbs energy during a phase transition to either provide heat or cooling. A phase transition is when the material transforms from one fundamental state of matter to another. For example, from a solid to a liquid or, in some cases a solid-to-solid phase change. Further, the point of transition, often referred to as the melt zone, may be tailored for specific temperature points based on the composition of the PCM material. For example, the use of hydrated salts may yield a phase change temperature from 46 degrees to 243 degrees Fahrenheit. Organic materials may yield a phase change temperature from 36 degrees to 327 degrees Fahrenheit. Eutectic materials may yield a phase change temperature from 32 degrees to −102 degrees Fahrenheit. And some solid-to-solid phase change materials may yield a phase change temperature from 77 degrees to 356 degrees Fahrenheit.

FIG. 1 plots temperature on the Y-axis 110 and time on the X-axis 120. FIG. 1 is an illustration of a heat sink application showing a steady state energy input 130 that may be indicative of a temperature within a product space within a mobile locker. Over time period 150 the ambient temperature rises to a melting point 115 of the PCM matter. At melting point 115 the PCM starts to absorb energy and constrains, or cools, the ambient temperature at melting point 115. The absorbing of energy continues through time period 160, maintaining the ambient temperature at melting point 115. At the end of time period 160 the PCM matter becomes exhausted, also referred to as exhaustion, and cannot absorb additional energy and thus the ambient temperature will rise as shown by trajectory 140.

FIG. 1 may also be read in reverse to shown how PCM matter can release energy in the event of a steady state energy output, or in other words, when the PCM is placed in a colder environment than its melting point. The graph is then interpreted from right to left whereas the ambient temperature is falling, at the PCM melting point the PCM will start to discharge or dissipate energy to maintain the melting point temperature until it becomes exhausted and then the temperature will continue to fall.

Figure 2:
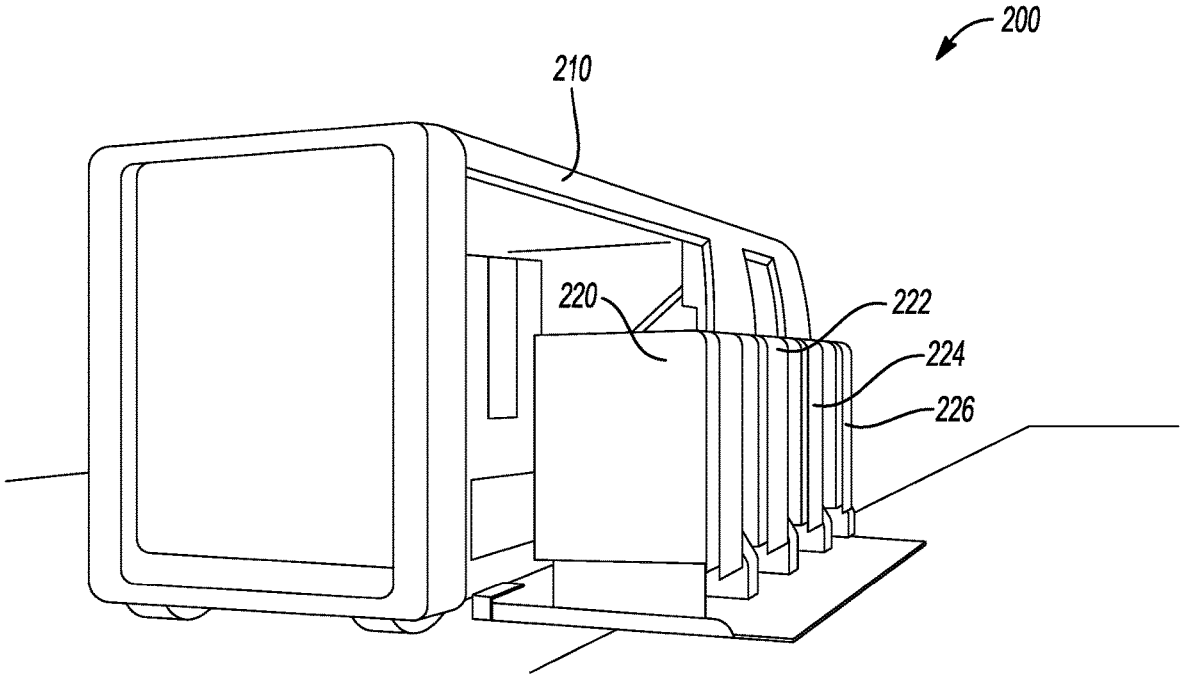
FIG. 2 is a perspective illustration of a mobile locker style storage system in accordance with the disclosure.

FIG. 2 is a perspective illustration of a mobile locker style storage system, according to an embodiment of the present disclosure. FIG. 2 includes a delivery vehicle 210 and multiple mobile lockers 220, 222, 224, and 226. FIG. 2 illustrates the concept that a mobile locker may be transported to a desired location and offloaded. As will be further discussed, mobile lockers 220, 222, 224, and 226 utilize a passive environmental control system that may be used to preserve grocery and other perishable items during transit and at a deliver point.

FIG. 3 is an illustration of a mobile locker system 300, according to an embodiment of the present disclosure. Mobile locker system 300 includes a mobile locker 310. Mobile locker 310, in this example, shows a 3×3 sample configuration of dispensing units including dispensing units 360-1, 360-2, 360-3, 360-4, 360-5, 360-6, 360-7, 360-8, and 360-9, collectively known as dispensing unit(s) 360. Mobile locker 310 may also include a control pad 320, an auxiliary power supply 330, tires 340, and an electrified powertrain system 350.

Each of dispensing units 360 may also include a cover access door, each of which are shown as closed in FIG. 3, that may be opened or removed to access the product space within. While mobile locker system 300 is shown as a 3×3 matrix configuration, multiple configurations are possible, from a single dispensing unit 360 to other practical configuration. Mobile locker system, as will be discussed, also may include a passive environmental control system to maintain a desired temperature range within dispensing units 360.

Control pad 320 may be used to navigate and control the mobile locker system 300 by utilizing the auxiliary power supply 330 and the electrified powertrain system 350. Tires 340 are shown as the method of moving mobile locker system 300 but could be of a variety of types of track, skid, or other wheel type configuration. Further, mobile locker 310 may also include insulation layers, not shown, throughout the structure, for example on the top, bottom, and sides to insulate the passive environmental control system.

Figure 4A:
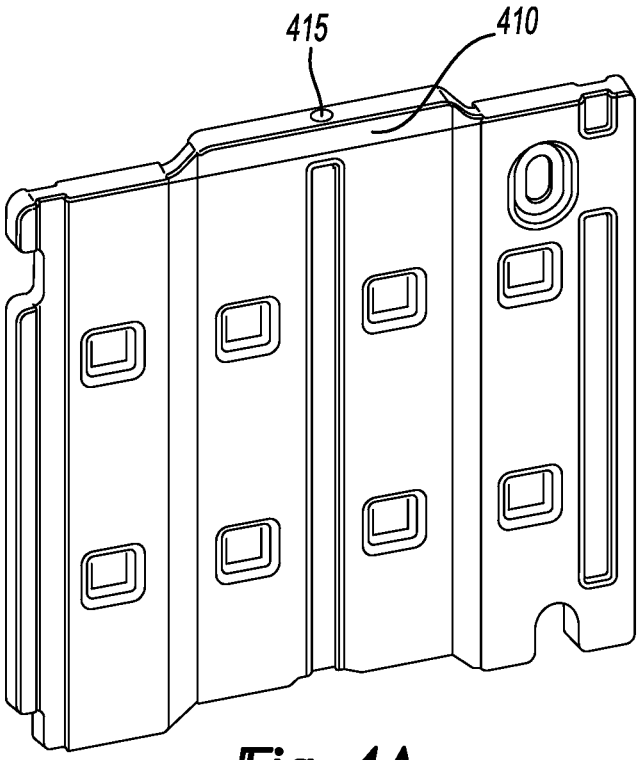
FIGS. 4A and 4B are illustrations of PCM containers for use in a mobile locker system in accordance with the disclosure.
Figure 4B:
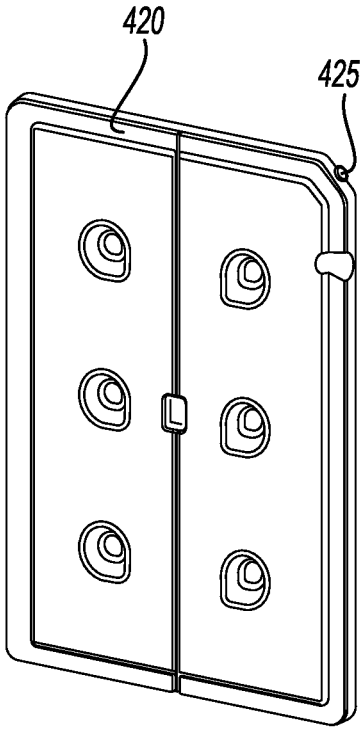

FIGS. 4A and 4B are illustrations of various PCM containers within a mobile locker system, according to an embodiment of the present disclosure. FIG. 4A represents a possible PCM container 410, which is also referred to as a bottle, which may be used as a wall or floor component within a mobile locker system, such as mobile locker 310. As will be shown in FIGS. 5A and 5B, PCM container 410 may comprise vertical wall sections of the mobile locker 310. Further, in the case of solid-liquid PCM matter, PCM container 410 may also include a cap 415, which may be removed to facilitate the filling or emptying of PCM material. Accordingly, PCM container 410 may function as a container for a variety of PCM matters.

FIG. 4B illustrates a PCM container 420 of a slightly different design than that of PCM container 410. PCM containers may be produced in various designs to accommodate the dimensions of product spaces within a mobile locker system and these illustrations are just examples and are not meant to limit a design of a PCM container. PCM container 420 also illustrates the use of a cap 425 to facilitate the use of liquid PCM matter.

Figure 5A:
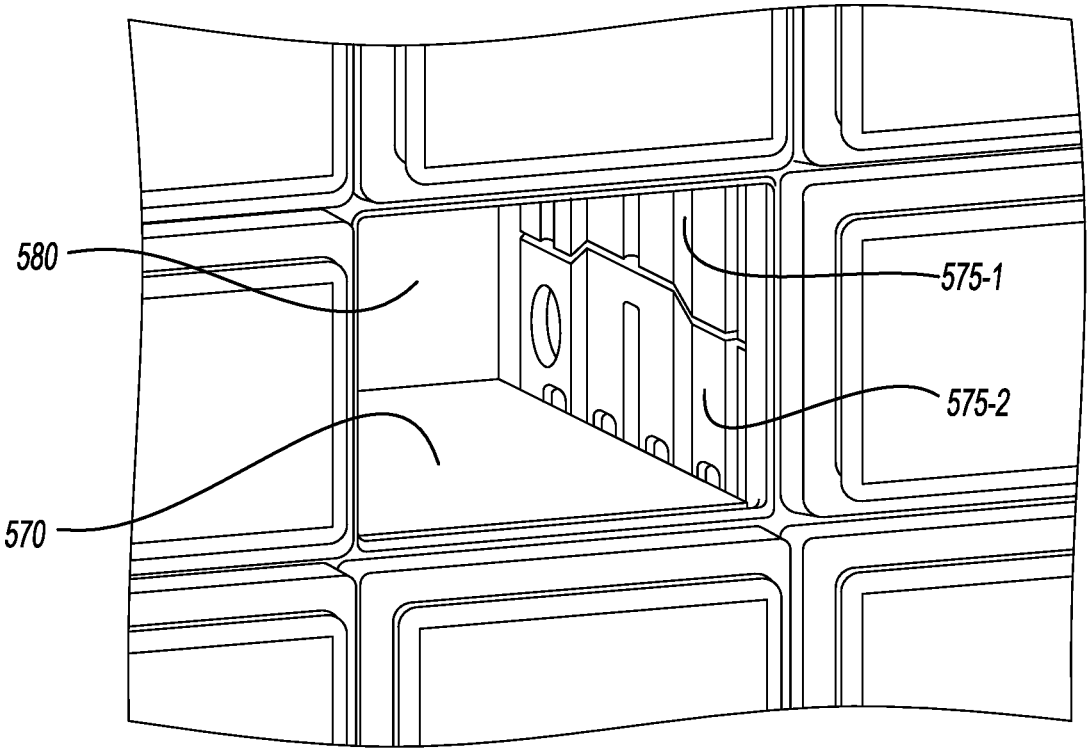
FIGS. 5A and 5B are illustrations of the use of PCM containers within a mobile locker system, shown with the access door removed, in accordance with the disclosure.
Figure 5B:
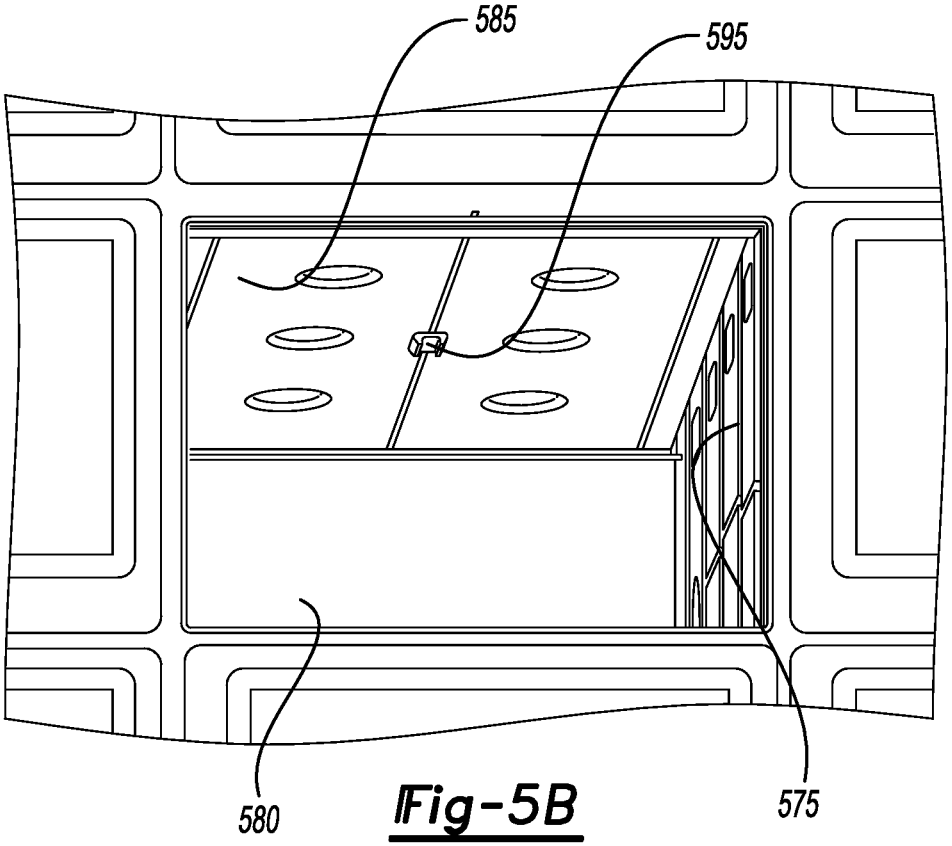

FIGS. 5A and 5B illustrate the use and possible placement of PCM containers within a product space in a dispensing unit of a mobile locker system, according to an embodiment of the present disclosure. FIGS. 5A and 5B are shown without their access doors/panels for illustration purposes. Further, FIGS. 5A and 5B are shown depicting dispensing unit 360-5, but the same or similar structure may be used for the dispensing units 360. FIG. 5A is a perspective view showing PCM containers 575-1 and 575-2 on the side wall of dispensing unit 360, with PCM container 580 comprising the back wall and PCM container 570 comprising the floor of dispensing unit 360. As shown with PCM containers 575-1 and 575-2, the containers are not constrained to be the size of a particular dispensing unit. Also shown with containers 575-1 and 575-2, the containers may be designed such that they may interlock in place.

FIG. 5B illustrates another perspective view of dispensing unit 360 showing a top PCM container 585 and the side PCM container 575. PCM container 585 may also include a temperature sensor 595. In an embodiment, each dispensing unit 360 may contain a temperature sensor 595. Temperature sensor 595 may be used to monitor and report the current temperature within each dispensing unit 360. In an embodiment, temperature sensor 595 may be communicatively coupled to sending, receiving, transmitting or transceiver circuitry that may send and/or temperature and temperature related data and other commands or data to and from a remote location for further tracking and processing. Such data, in addition to tracking current temperature levels, may identify temperature trends. Such trends may include a change in outside environment conditions in addition to possible degradation of the PCM matter. In other words, a change in temperature sensor 595 data may indicate the useful remaining lifespan of PCM matter in a dispensing unit 360 in mobile locker 310. Upon reaching a predetermined threshold the data may indicate the need to initiate remedial PCM actions such as retrieval of the mobile locker 310 and subsequent reconditioning of the PCM matter.

Figure 6:
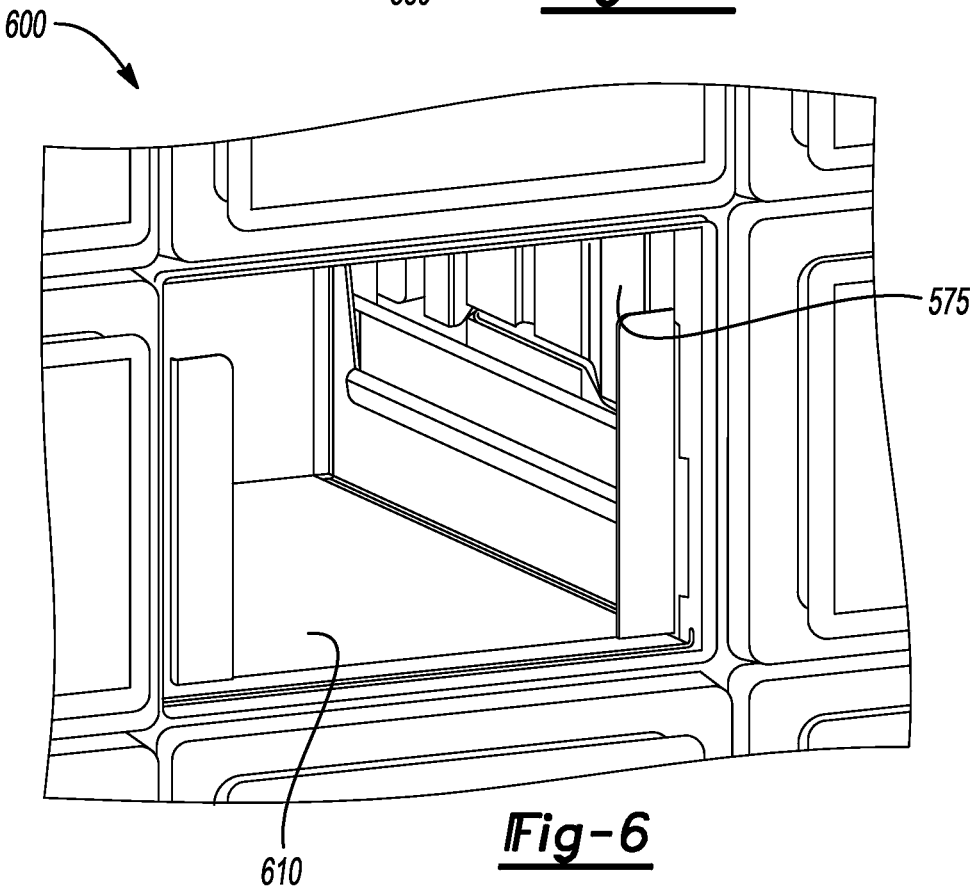
FIG. 6 is an illustration of a removable drawer configured to hold content within a storage space in a mobile locker system, shown with the access door removed, in accordance with the disclosure.

FIG. 6 is an illustration of a mobile locker system 600, according to an embodiment of the present disclosure. Mobile locker system 600 includes a shelfing system 610, which in an embodiment is configured to slide out of the dispensing unit. Also shown is a partial view of the PCM container 575 on the side wall.

Figure 7:
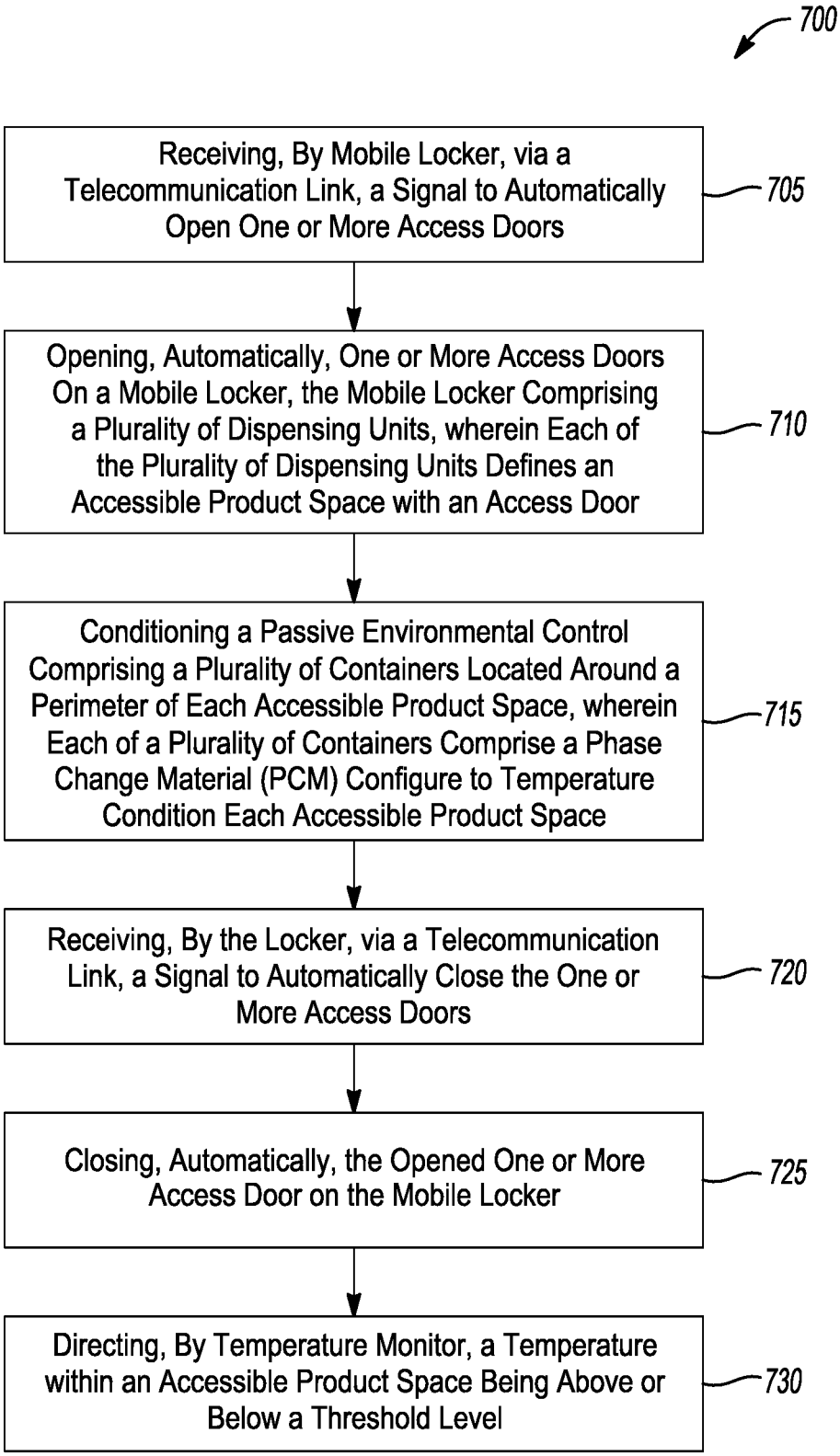
FIG. 7 depicts a flowchart of a method for temperature controller transport of product using a mobile locker system, in accordance with the disclosure.

FIG. 7 shows an exemplary embodiment of a method for the temperature controlled transport of product using a mobile locker system. Method 700 begins at 705 by the receiving, by the mobile locker, via a telecommunications link, a signal to automatically open one or more access doors. As discussed above in the Summary section, PCM matter can be conditioned by placing the PCM matter in an area where the desired temperature for conditioning is available. For example, if the PCM matter has a melting point of 70 degrees Fahrenheit, exposing the PCM matter to a room conditioned temperature of 68 degrees Fahrenheit would be sufficient to condition, or recondition, the PCM matter. However, as the mobile locker, such a mobile locker 310, comprises an access door, that door may be opened to allow the room conditioned air of 68 degrees Fahrenheit to enter the accessible product space within each dispensing unit, such as shown in FIGS. 5A and 5B with PCM containers 570, 575, 580, and 585. The same scenario is applicable where the mobile locker 310 may be located within a freezer to condition PCM with a melting point at a lower temperature, for example at 5 degrees Fahrenheit. In either case, in an embodiment the access doors may be controlled from a remote location via a telecommunication link. Further, in an embodiment, the mobile locker may also be configured to respond to commands from a remote location, for example a confirmation signal that a command was received and/or that the command has been successfully executed. The ability to receive and executed remote commands allows for contactless control of mobile lockers, for example when the mobile lockers are in a secured location.

At 710, based on the receipt of the signal at 705, one or more of the access doors, such as the access doors shown in FIG. 3, are automatically opened to expose the accessible product space of the corresponding dispensing units. As discussed at 705, once one or more of the access doors are opened, mobile locker 310 may generate a confirmation signal that the requested task to open the one or more doors has been accomplished. In an embodiment, a temperature monitor, such a temperature monitor 595, located in dispensing units 360 may monitor and report the temperature of each dispensing unit 360 during the conditioning or reconditioning process.

At 715, once the access doors to the dispensing units are opened and exposed to the surrounding environment, the accessible product space that is lined with PCM may be conditioned at the temperature of the surrounding environment. Such conditioning, as previously discussed may be selected to be as low as 40 degrees or up to 100 degrees Fahrenheit, or anywhere in between. Such limits are discussed as being a typical range that is suitable for mobile lockers, however, as discussed, PCM matter can have melting points of considerable range from extreme sub-zero to several thousand degrees Fahrenheit.

At 720, mobile locker may receive via the telecommunications link a signal to automatically close the one or more access doors that have been opened. The receipt of a signal to close the one or more access doors may be based on the PCM matter in the containers within the dispensing units have been fully conditioned. Such a reconditioning may be determined by temperature sensors, such as temperature sensor 595, reporting a stable conditioned temperature within the dispensing units. Or, in an embodiment, the decision to close the access doors may be based on an elapsed time in which it is estimated to be sufficiently long to condition the PCM matter.

At 725 the access doors in the mobile locker are actually closed based on the receipt of the signal in 720.

At 730, once the access doors are closed, the temperature monitor may detect the temperature within each of the dispensing units. If a temperature exceeds a predetermined threshold, for example when the accessible product space within a dispensing unit gets too warm by exceeding a threshold temperature or when the temperature within the accessible product space become too cold by exceeding, e.g., lower than the threshold, then, based on the detecting may alert a remote system of crossing the threshold. Method 700 may then end.

The description and abstract sections may set forth one or more embodiments of the present disclosure as contemplated by the inventor(s), and thus, are not intended to limit the present disclosure and the appended claims.

Embodiments of the present disclosure have been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof may be appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments.

Exemplary embodiments of the present disclosure have been presented. The disclosure is not limited to these examples. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the disclosure.

What is claimed is:

1. A mobile locker comprising:

a housing configured with a plurality of wheels; and a plurality of modular dispensing units within the housing, wherein each of the plurality of modular dispensing units define an accessible product space with a temperature sensor, wherein each of the plurality of modular dispensing units include a passive environmental control comprising a plurality of containers located around a perimeter of each accessible product space;

wherein a first portion of the modular dispensing units include containers comprising a first phase change material (PCM) with a first melting point configured to temperature condition each accessible product space in the first portion;

wherein a second portion of the modular dispensing units include containers comprising a second PCM with a second melting point configured to temperature condition each accessible product space in the second portion; and wherein the first melting point is different from the second melting point.

2. The mobile locker of claim 1, further comprising a power supply and an electrified powertrain system configured to propel the mobile locker.

3. The mobile locker of claim 1, wherein the PCM is configured to temperature condition an accessible product space in a cooling mode comprising absorbing energy.

4. The mobile locker of claim 1, wherein the PCM is configured to temperature condition an accessible product space in a heating mode comprising discharging energy.

5. The mobile locker of claim 1, wherein upon an exhaustion of the PCM resulting in an inability to maintain environmental control, the PCM is configured to be reconditioned.

6. The mobile locker of claim 5, wherein the reconditioning is passive.

7. The mobile locker of claim 6, wherein the passive reconditioning is configured to locate the mobile locker in an environment suitable for PCM reconditioning.

8. The mobile locker of claim 1, wherein each of the plurality of containers is modular and removable from the mobile locker.

9. The mobile locker of claim 8, wherein each of the plurality of containers is configured to be reconfigured with a different type of PCM.

10. The mobile locker of claim 1, wherein each temperature sensor is configured to indicate a temperature within an accessible product space being above or below a threshold level.

11. The mobile locker of claim 1, wherein the plurality of containers located around a perimeter of each accessible product space further comprises a plurality of vertically oriented containers and a plurality of horizontally oriented containers.

12. The mobile locker of claim 11, wherein the plurality of vertically oriented containers comprises a third PCM with a third melting point and the plurality of horizontally oriented containers comprises a fourth PCM with a fourth melting point, wherein the third melting point is different from the fourth melting point.

13. The mobile locker of claim 1, wherein each dispensing units further comprises a drawer configured to hold content.

14. The mobile locker of claim 1, wherein the first or second PCM has a melting point between 40 to 100 degrees Fahrenheit.

15. A mobile locker style storage system comprising:

one or more mobile lockers;

a delivery vehicle configured to transport the one or more mobile lockers, wherein each mobile locker comprises:

a housing configured with a plurality of wheels; and a plurality of modular dispensing units within the housing, wherein each of the plurality of modular dispensing units define an accessible product space with a temperature sensor, wherein each of the plurality of modular dispensing units include a passive environmental control comprising a plurality of containers located around a perimeter of each accessible product space;

wherein a first portion of the modular dispensing units include containers comprising a first phase change material (PCM) with a first melting point configured to temperature condition each accessible product space in the first portion;

wherein a second portion of the modular dispensing units include containers comprising a second PCM with a second melting point configured to temperature condition each accessible product space in the second portion; and wherein the first melting point is different from the second melting point.

16. The locker style storage system of claim 15, wherein each of the accessible product spaces are configured to preserve grocery and perishable items.

* * * * *